US009108420B2

(12) United States Patent
Karasawa

(10) Patent No.: US 9,108,420 B2
(45) Date of Patent: Aug. 18, 2015

(54) LIQUID CONTAINING BODY

(71) Applicant: SEIKO EPSON CORPORATION, Tokyo (JP)

(72) Inventor: Masahiro Karasawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/470,349

(22) Filed: Aug. 27, 2014

(65) Prior Publication Data

US 2015/0062263 A1 Mar. 5, 2015

(30) Foreign Application Priority Data

Sep. 4, 2013 (JP) ..... 2013-183175

(51) Int. Cl.
*B41J 2/175* (2006.01)

(52) U.S. Cl.
CPC ..... *B41J 2/17553* (2013.01); *B41J 2/17513* (2013.01); *B41J 2/17533* (2013.01)

(58) Field of Classification Search
USPC ..... 347/85, 86, 87
See application file for complete search history.

(56) References Cited

U.S. PATENT DOCUMENTS

| | | | | |
|---|---|---|---|---|
| 5,400,066 | A * | 3/1995 | Matsumoto et al. | 347/86 |
| 6,281,911 | B1 * | 8/2001 | Nakazawa et al. | 347/36 |
| 6,325,500 | B1 * | 12/2001 | Kitabatake et al. | 347/86 |
| 6,834,945 | B2 * | 12/2004 | Ishizawa et al. | 347/86 |
| 8,857,968 | B2 * | 10/2014 | Fujii et al. | 347/100 |
| 2005/0151813 | A1 | 7/2005 | Ikezaki | |
| 2008/0136878 | A1 | 6/2008 | Nozawa et al. | |

FOREIGN PATENT DOCUMENTS

| | | | |
|---|---|---|---|
| EP | 0423374 | A1 | 4/1991 |
| EP | 0439728 | A2 | 8/1991 |
| EP | 0543315 | A2 | 5/1993 |
| EP | 1234673 | A2 | 8/2002 |
| EP | 1348555 | A1 | 10/2003 |
| EP | 1454753 | A1 | 9/2004 |
| EP | 2147792 | A1 | 1/2010 |
| JP | 2008-273173 | A | 11/2008 |
| JP | 2013-018823 | A | 1/2013 |
| WO | 2010/024096 | A1 | 3/2010 |

OTHER PUBLICATIONS

Extended European Search Report for European Patent Application No. 14183170.1 dated Feb. 4, 2015.

* cited by examiner

*Primary Examiner* — Anh T. N. Vo
(74) *Attorney, Agent, or Firm* — Global IP Counselors, LLP

(57) ABSTRACT

The liquid containing body includes a flexible member configured to contain liquid which is hardened by irradiation of ultraviolet light, a supply member that is connected to the flexible member and includes a supply port configured to supply the liquid to a liquid ejecting device from the flexible member, a first containing body that houses the flexible member and the supply member, and is transparent or translucent to allow the ultraviolet light to pass through, and a second containing body that houses the first containing body and is configured to block the ultraviolet light and visible light.

7 Claims, 9 Drawing Sheets

20
270
271
272
230
210
Z
X
Y 30
310
312
20
Z
X
Y 40
410
414
416
416
20
412
310
Z
X
Y

LIQUID CONTAINING BODY

CROSS-REFERENCE TO RELATED APPLICATIONS

This application claims priority to Japanese Patent Application No. 2013-183175 filed on Sep. 4, 2013. The entire disclosure of Japanese Patent Application No. 2013-183175 is hereby incorporated herein by reference.

BACKGROUND

1. Technical Field

The present invention relates to a liquid containing body.

2. Related Art

A carriage for storing ink (print material) for supplying to a printer (printing device) has been well known. Among cartridges like this, there is a cartridge storing ink in a bag-shaped flexible member (for example, see Japanese Laid Open Publication No. 2008-273173). Also, ultraviolet curable ink (UV ink) which is hardened by irradiating ultraviolet light (UV light) is well known for ink used for printing (for example, see Japanese Laid Open Publication No. 2013-18823).

UV ink is good in degree of freedom in selecting a base material and in fast dry, when compared with aqueous ink. For the cartridge storing the UV ink, it is necessary to block sun light and light from the lighting device or the like (ultraviolet light and visible light with wavelength of approximately 300-500 nm (nanometer) including visible light) from reaching the UV ink until other cartridges are exchanged after being equipped on the printer following a distribution process after the cartridge is filed with the UV ink, in order to prevent hardening of the UV ink. UV ink has skin irritation property such that it should be handled with care.

The cartridge of Japanese Laid Open Publication No. 2008-273173 has a problem of hardening the UV ink in the cartridge because it is not planned to store the UV ink. Also, the cartridge of Japanese Laid Open Publication No. 2008-273173 has a problem in not enough paying attention to preventing a contact a user with the UV ink. Other than that, miniaturization, resource saving, facilitation of manufacturing, and enhancing usability have been awaited. The above mentioned problems are not only for the cartridge storing the UV ink, but also for the liquid containing body storing other liquid which is hardened by irradiation of the ultraviolet light.

SUMMARY

The present invention solves at least part of the above problems, and possible to realize in embodiments below.

According to one embodiment of the invention, the liquid containing body is provided. The liquid containing body includes a flexible member configured to contain liquid which is hardened by the irradiation of ultraviolet light, a supply member connected to the flexible member and including a supply port configured to supply the liquid from the flexible member to a liquid ejecting device, a first containing body housing the flexible member and the supply member, and being transparent or translucent to allow the ultraviolet light to pass through, and a second containing body housing the first containing body and configured to block the ultraviolet light and the visible light. According to this arrangement, the second containing body attains light shielding property by the second containing body, and thus can enhance quality of material of the flexible member and the supply member, and a degree of freedom in design. Further, in a state in which the second containing body is extracted from the first containing body, the user can confirm a leak of the liquid outside of the first containing body, and it is possible to prevent the user from making contact with the liquid.

In the above mentioned arrangement of the liquid containing body, the flexible member and the supply member are sealed in the first containing body, and the first containing body is partially closed in the second containing body. According to the arrangement, being compared with the second containing body being sealed, the second containing body is not damaged in a process of opening the second containing body because the user can easily open the first containing body. As a result, in a state in which the liquid is leaked inside the first containing body, the contact of the user with the liquid is prevented due to the damage of the second containing body.

The liquid containing body of the above arrangement includes a protruding section which protrudes from an applied section in a state in which the supply member is equipped on the applied section of the liquid ejecting device, and a medium on which information with regards to the liquid is described and which is arranged on the protruding section. According to the arrangement, the information regarding the liquid is presented at a position in which the user can recognize for the liquid ejecting device.

For the above mentioned liquid containing body, the supply member is configure to block the ultraviolet light and the visible light. According to the arrangement, in a state in which the second containing body is removed, it is possible to prevent the liquid from being hardened by the ultraviolet light and the visible light passing through the supply member.

The liquid containing body of the above arrangement further includes the housing which is housed in the first containing body, and houses the flexible member and the supply member, and is configured to block the ultraviolet light and the visible light. The flexible member is configured to allow the ultraviolet light and the visible light to pass through. According to the arrangement, because the second containing body can possesses the light shielding property by the housing in the state in which the second containing body is removed, the degree of the freedom in the design of the flexible member can be enhanced without being restricted by the possession of the light shielding property.

For the above mentioned liquid containing body, the supply member forms a communicating chamber extending and communicating with the supply port from the inside of the flexible member in order for the liquid to flow, and the liquid containing body further comprises a wall member which is arranged in the supply member, forms the communicating chamber with the supply member, and is configured to bend based on internal pressure of the communicating chamber, and a lever member which is arranged on the supply member, is in contact with the wall member, and is configured to move largely in comparison with amount of bending of the wall member based on the bending of the wall member. The supply member, the wall member, and the lever member are configured to block the ultraviolet light and the visible light. According to the arrangement, in the state in which the second containing body is removed, it is possible to prevent the liquid from being hardened by the ultraviolet light and the visible light passing through the wall supply member, the wall member, and the lever member.

For the above mentioned liquid containing body, absorbance in a range from an outside of the second containing body to an inside of the flexible member in the liquid containing body is equal to and less than 0.0001% for more than and equal to 200 nm and less than 500 nm of the wavelength.

According to the arrangement, the light shielding property is adequately attained for preventing the liquid from being hardened by light more than and equal to 200 nm and less than and equal to 500 nm in wavelength.

Not all the plurality of elements which each of the above mentioned arrangements of the present invention possesses is necessary, but it is possible to change, delete, exchange with other elements, and delete part of limitations, as necessary, in order to solve all or part of the above mentioned problems, or attain all or part of the effect which the present specification recites. Also, in order to solve all or part of the above mentioned problems, or attain all or part of the effect which the present specification recites, one independent arrangement of the present invention can be formed by combining all or part of technical features included in the above mentioned arrangement of the present invention with all or part of the abovementioned other arrangements of the present invention.

For example, one arrangement of the present invention can be realized as a device including at least one of four elements, as the flexible member, the supply member, the first containing body, and the second containing body. In other words, it is fine that the device of the present invention includes or does not have to include the flexible member. Also, it is fine that the device of the present invention includes or does not have to include the supply member. Also, it is fine that the device of the present invention include or does not have to include the first containing body. Also, it is fine that the device of the present invention include or does not have to include the second containing body.

The flexible member, for example, can be a flexible member to contain the liquid which is hardened by the irradiation of the ultraviolet light. The supply member, for example, can be a supply member on which the supply port is formed in order to supply to a liquid ejecting device the liquid from the flexible member. The first containing body can be a first containing body which houses the flexible member and the supply member, is transparent or translucent, and passes the ultraviolet light. The second containing body, for example, can be a second containing body which houses the first containing body, and blocks the ultraviolet light and the visible light.

The device like this, for example, can be realized as the liquid containing body, but also a device other than the liquid containing body to be realized. According to the arrangement like this, at least one of various problems such as the miniaturization of the device, the cost reduction, the resource saving, the facilitation of manufacturing, the usability enhancement, and the like can be solved. All or part of the technical features of each of the arrangement of the liquid containing body can be applied to the device like this.

The present invention can be realized in various arrangements other than the liquid containing body. For example, a manufacturing method of a liquid ejecting device or a liquid containing body to which at least part of the liquid containing body is equipped.

BRIEF DESCRIPTION OF THE DRAWINGS

Referring now to the attached drawings which form a part of this original disclosure.

DETAILED DESCRIPTION OF EXEMPLARY EMBODIMENTS

A. First Embodiment

A-1. Configuration of Liquid Ejecting System

Figure 1:
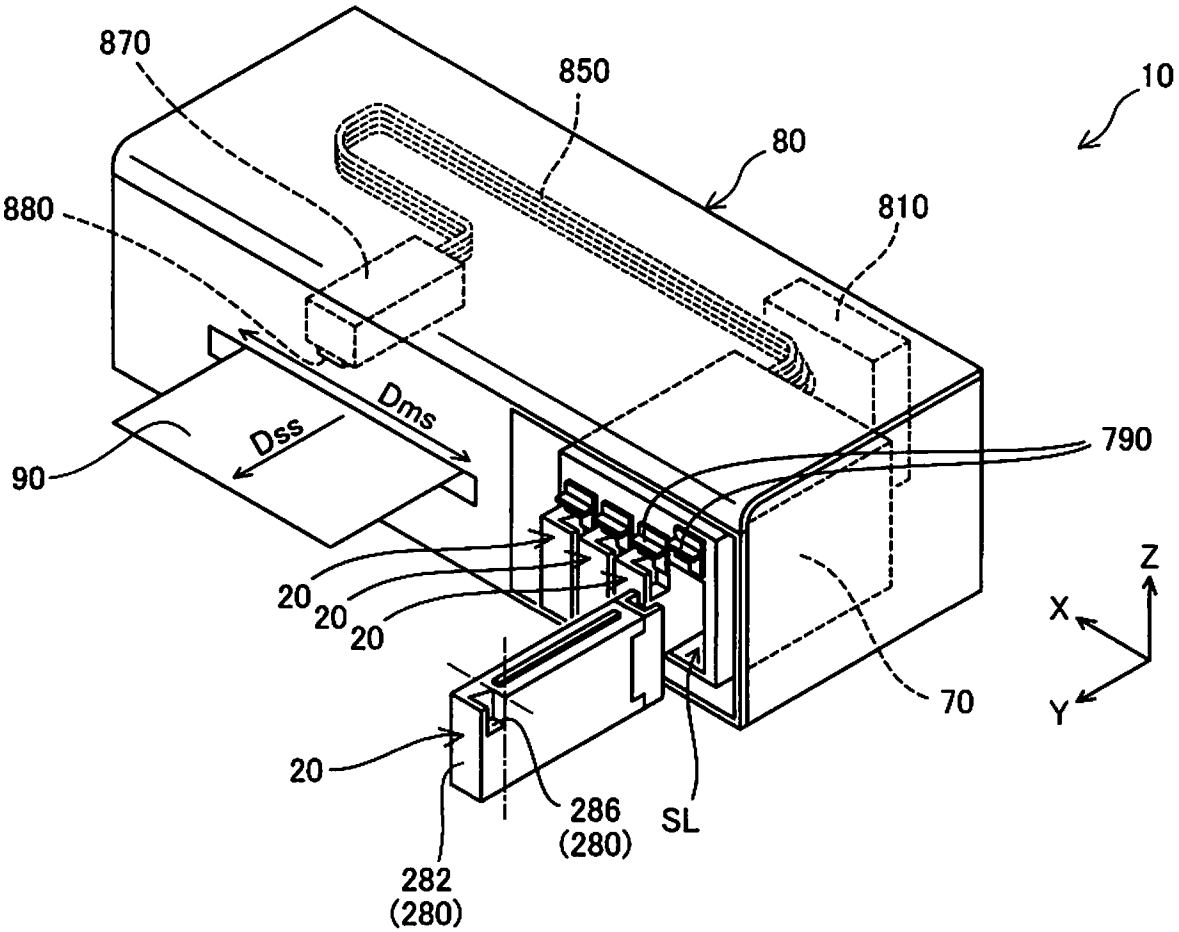
FIG. 1 is a diagrammatic perspective view of a liquid ejecting system.

FIG. 1 is a diagrammatic perspective view showing a liquid ejecting system 10. FIG. 1 showing XYZ axes which mutually perpendicularly intersects. The XYZ axes in FIG. 1 corresponds to XYZ axes in other figures. In the present embodiment, in a state in which the liquid ejecting system 10 is in use, the Z axis of the XYZ axes extends in the gravity. A direction of +Z axis is upwards opposite to the gravity, while a −Z axis is downwards with the gravity. The state in which the liquid ejecting system 10 is in use is a state in which the liquid ejecting system 10 is on the horizontal surface, wherein an XY plane is a horizontal surface in the present embodiment.

The liquid ejecting system 10 include a cartridge 20 as the liquid containing body, and a printer 80 as the liquid ejecting device. In the present embodiment, the cartridge 20 is, as it is called, an ink cartridge, and the printer 80 is, as it is called, an ink jet printer. The printer 80 includes a holder 70 holding the cartridge 20. A slot SL which is a space is formed on the holder 70 to accommodate the cartridge 20. The cartridge 20 is detachably attached to the holder 70. The cartridge 20 supplies UV ink being a print material being liquid which is hardened by irradiation of ultraviolet light to the printer 80. The printer 80 ejects a liquid droplet of the UV ink from the cartridge 20 to a print medium 90 such as paper or a label, and prints print information such as characters, figures, or images on the print medium by irradiating the UV ink ejected to the print medium 90 with the ultraviolet light.

In the present embodiment, a plurality of cartridge 20 are attachable to the holder 70. In the present embodiment, each of four kinds of the cartridges 20, namely total four of the cartridges 20 are equipped to the holder 70 to correspond to four colors (black, yellow, magenta, and cyan) of the UV ink. The number of the cartridges 20 being attachable to the holder 70 is not limited to four, but is changeable to any number, can be less than four, and can be more than four. The kind of the UV ink contained in the cartridge 20 is not limited to four kinds, but can be less than four kinds, and can be more than four kinds.

The printer 80 of the liquid ejecting system 10 includes a control section 810, a carriage 870, and a print head 880, other than the holder 70. The control section 810 controls the printer 80. The carriage 870 can move the print head 880 relatively to the print medium 90. The print head 880 ejects to the print medium 90 the UV ink from the cartridge 20 on the basis of the control signal from the control section 810.

In the present embodiment, the holder 70 which holds the cartridge 20 is configured in a different place from the carriage 870. The printer like this is also called an off-carriage type, and the UV ink of the cartridge 20 is supplied to the print head 880 of the carriage 870 via a flexible tube 850. In a different embodiment, the holder 70 which holds the cartridge 20 is fine to be configured on the carriage 870 with the print head 880. The printer like this is also called as on-carriage type.

In the present embodiment, the printer 80 includes a main scanning feeding mechanism and a the sub-scanning feeding mechanism in order to move the carriage 870 and the print medium 90 relatively in order to realize printing. The main feeding mechanism of the printer 80 moves the carriage 870 in a main scanning direction Dms back and forth on the basis of the control signal form the control section 810. A the sub-scanning feeding mechanism of the printer 80 transfers the print medium 90 in a sub-scanning direction Dss which intersects with the main scanning direction Dms on the basis of the control signal from the control section 810.

In the present embodiment, in the state in which the liquid ejecting system 10 is in use, the X axis of the XYZ axes is along the main-scanning direction, which the Y axis of the XYZ axes is along the sub-scanning direction. When a side of extracting the print medium 90 in printing is on a front side of the liquid ejecting system 10, a direction of +Y axis is a forward direction forwardly extending from a back side of the liquid ejecting system 10 and a −Y axis direction is a rearward direction rearwardly extending from the front side to the back side of the liquid ejecting system 10. In this case, +X axis direction is a left side direction going to a left side of the liquid ejecting system 10, and −X axis direction is a right direction to a right side of the liquid ejecting system 10. In the description of the cartridge 20, the XYZ axes towards the cartridge 20 in a state in which the holder 70 is attached are on the cartridge 20.

In the present embodiment, the cartridge 20 includes a protruding section 280 which protrudes from the holder 70 as being as the applied section, in the state in which the holder 70 is equipped. The protruding section 280 of the cartridge 20 is a part on a +Y axis direction side of the cartridge 20. A surface section 282 and the recessed section 286 are configured on the protruding section 280. The surface section 282 constitutes a surface facing the +Y axis direction. The recessed section 286 has a shape like an outer surface of the cartridge 20 being recessed. In the present embodiment, a ridge of the cartridge 20 is partially recessed along the Y axis configured on a side of the −X axis and a side of the +Z axis.

In the present embodiment, the user of the liquid ejecting system 10 equips the cartridge 20 to the holder 70 by moving the cartridge 20 in the −Y axis direction to the holder 70. In the present embodiment, the user of the liquid ejecting system 10 can easily equip the cartridge 20 to the holder 70 by urging the surface section 282 of the cartridge 20 in the −Y axis direction. In the present embodiment, a stopper 790 which is engaged with the recessed section 286 of the cartridge 20 being equipped on the holder 70 is configured on the holder 70 By this, the cartridge 20 can be prevented from detached from the holder 70 inadvertently.

In the present embodiment, the user of the liquid ejecting system 10 removes the cartridge 20 form the holder 70 by moving the cartridge 20 being equipped on the holder 70 in the +Y axis direction. In the present embodiment, the user of the liquid ejecting system 10 can easily detach the cartridge 20 from the holder 70 by putting a finger on the recessed section 286.

A-2. Detailed Configuration of Liquid Containing Body

Figures 2A, 2B, 2C:
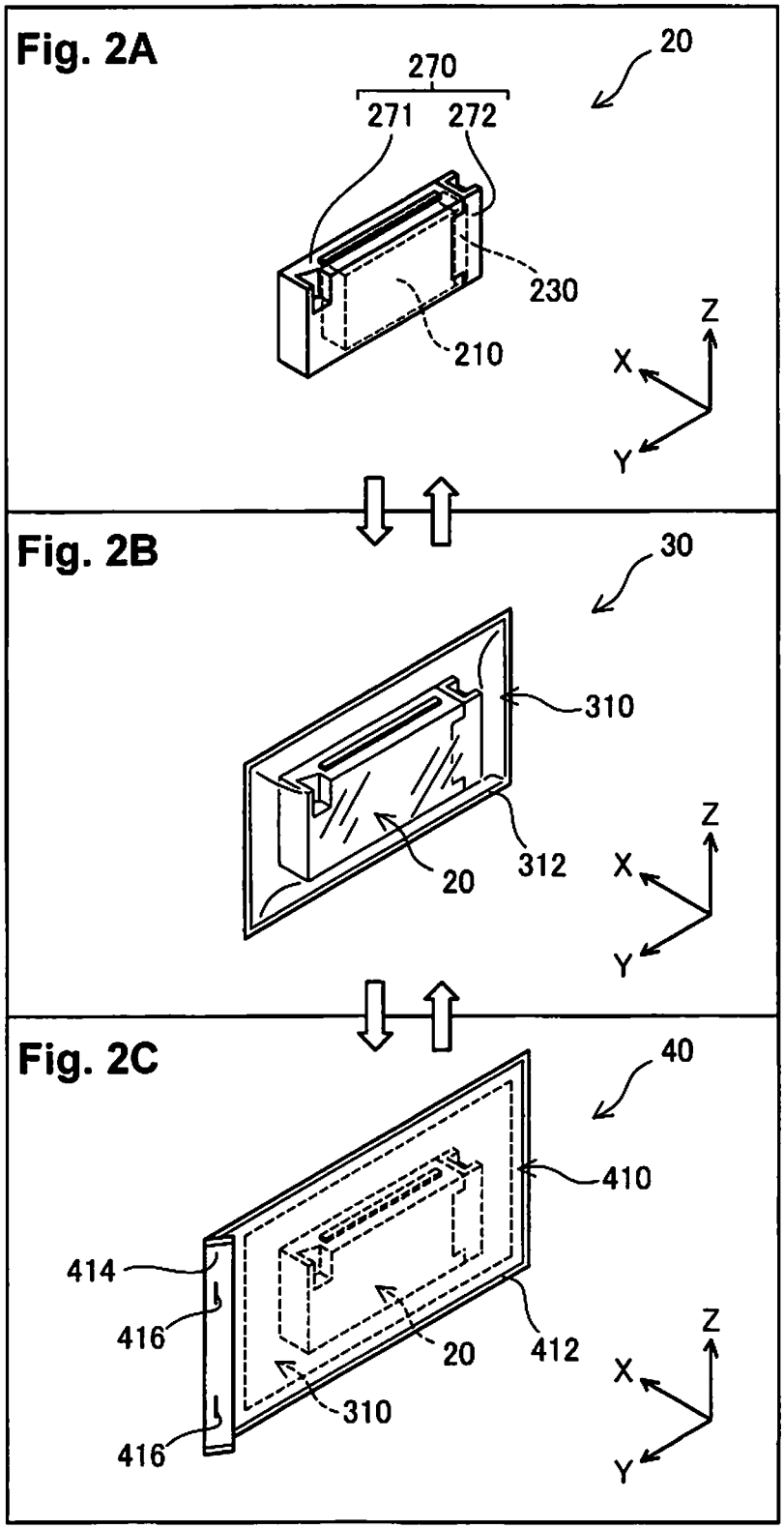
FIGS. 2A, 2B, and 2C are explanatory views showing various liquid containing bodies.

FIGS. 2A, 2B and 2C are explanatory views of various kinds of a liquid containing body. FIG. 2A is a diagrammatic perspective view showing the cartridge 20. FIG. 2B is a diagrammatic perspective view showing the liquid containing body 30. FIG. 2C is a diagrammatic perspective view showing the liquid containing body 40.

As FIG. 2A shows, the cartridge 20 includes a flexible member 210, a supply member 230, and a housing 270.

The flexible member 210 of the cartridge 20 contains the UV ink as an example of liquid which is hardened by the irradiation of the ultraviolet light. The flexible member 210 is a part made of a flexible thin plate formed in a bag shape, and stores the UV ink inside the flexible member 210. In the present embodiment, the flexible member 210 is made of transparent film formed in the bag shape, and passes the ultraviolet light and the visible light. In the present embodiment, the file for the flexible member 210 is a laminated film having a polyethylene (PE) layer, an ethylene-vinyl alcohol copolymer (EVOH) layer, a nylon layer, a polyethylene terephthalate (PET) layer, and the like. In another embodiment, the flexible member 210 can be a part which blocks the ultraviolet light or the visible light by using a colored film (for example, a laminated film having a black print layer), or a part which blocks the ultraviolet light or the visible light by using a laminated layer having an aluminum layer.

The supply member 230 of the cartridge 20 is connected to the flexible member 210 and is a part configured to supply the UV ink to the printer 80 from the flexible member 210. In the present embodiment, the supply member 230 and the flexible member 210 are welded. In the present embodiment, the supply member 230 is a part made of a synthetic resin which is colored in black, and blocks the ultraviolet light and the visible light. In the present embodiment, the synthetic resin used in the supply member 230 is polyethylene (PE) in which a black master batch of 4 weight % (made by "Toyo Color Co., Ltd." "TET OCA041 Black") is kneaded. In the present embodiment, absorbance of the supply member 230 is equal to or less than 0.0001% (by a measuring method of JIS (Japanese Industrial Standard) K 0115:2004) against equal to or more than 200 nm to equal to or less than 500 nm in wavelength. In another embodiment, the supply member 230 can be a part which passes the ultraviolet light and the visible light.

The housing 270 of the cartridge 20 is a part which houses the flexible member 210 and the supply member 230. In the present embodiment, the housing 270 includes a container section 271 having larger capacity than the flexible member 210, and a lid section 272 which is set to the container section 271. The container section 271 houses the flexible member 210 inside. On the side of −Y axis direction of the container section 271, the supply member 230 is held. The lid section 272 is set on the container section 271 on the side of the −Y axis direction thereof. The lid section 272 houses the supply member 230 inside. In the present embodiment, the housing 270 is a part made of the synthetic resin which is colored in black, and blocks the ultraviolet light and the visible light. In the present embodiment, the synthetic resin used in the housing 270 is polypropylene (PP) in which a black master batch of 4 weight % (made by "Toyo Color Co., Ltd." "TPP OSD041 Black") is kneaded. In the present embodiment, absorbance of the housing 270 is equal to or less than 0.0001% (by a measuring method of JIS (Japanese Industrial Standard) K 0115:2004) against equal to or more than 200 nm to equal to or less than 500 nm in wavelength. In another embodiment, the housing 270 can be a part which passes the ultraviolet light and the visible light.

As FIG. 2B shows, the liquid containing body 30 includes a bag 310 which houses the cartridge 20. The bag 310 is the first containing body housing the flexible member 210 and the supply member 230. In the present embodiment, the bag 310 includes the housing 270 which houses the flexible member 210 and the supply member 230. The bag 310 is a part which is formed from a transparent film in a bag shape, and passes the ultraviolet light and the visible light. In the present embodiment, the film for the bag 310 is made of synthetic resin (for example, polyethylene (PE)). In another embodiment, the bag 310 can be translucent.

In the liquid containing body 30, the cartridge 20 is sealed in the bag 310. In the present embodiment, the cartridge 20 is sealed in the bag 310 because the bag 310 is welded. In another embodiment, the cartridge 20 is sealed in the bag 310 by bonding the bag 310 by adhesive material (for example, adhesive tape, adhesive agent, or the like).

In the present embodiment, the bag 310 is formed by welding the entire circumference of two films which the two films sandwich the cartridge 20. For this reason, the bag 310 includes a welding section 312 in the entire circumference. In another embodiment, the bag 310 can be formed by welding one file by folding it in half and welding, or formed by welding more than three films.

As FIG. 2C shows, the liquid containing body 40 includes a bag 410 housing the bag 310. The bag 410 is the second containing body which houses the bag 310. The bag 410 houses the bag 310 including the cartridge 20 which is houses in the bag 310. The bag 410 blocks the ultraviolet light and the visible light. In the present embodiment, the bag 410 is a part formed of a laminated film having a colored film layer (for example, a print layer in black) in a bag shape. In another embodiment, the bag 410 can be a part formed of a laminated film including an aluminum layer in a bag shape. In the present embodiment, absorbance of the bag 410 is equal to or less than 0.0001% (by a measuring method of JIS (Japanese Industrial Standard) K 0115:2004) against equal to or more than 200 nm to equal to or less than 500 nm in wavelength.

In the liquid containing body 40, the bag 310 is partially closed in the bag 410. In the present embodiment, the bag 410 is formed by folding two rectangular-shaped films and welding three sides thereof, folding a side which is not folded in a state in which the bag 310 is enclosed in it, and closing partially by the stapler 416. For this reason, in the bag 410, a welding section 412 is formed at the three sides, and a bent section 414, which is formed by folding the side being not welded, is closed by the stapler 416. In another embodiment, the bag 410 can be partially closed by welding, partially closed by an adhesive material (for example, adhesive tape, adhesive agent, or the like), or partially closed by a clip (clip). Also, the bag 410 does not have to be closed partially by the stapler 416 or the like, or can be simply folded at the bent section 414.

A manufacturer of the cartridge 20 forms the cartridge 20 until in a state shown in FIG. 2A, and thereafter the cartridge 20 is housed in the bag 310. By this, the cartridge 20 becomes in a state shown in FIG. 2B, namely becoming the liquid containing body 30. Thereafter, the manufacturer houses the liquid containing body 30 in the bag 410. By this, the liquid containing body 30 becomes in a state in FIG. 2C, namely becoming the liquid containing body 40. Thereafter, the liquid containing body 40 is shipped from a factory, and distributed to a market.

The user of the liquid ejecting system 10 removes the bag 310 from the bag 410 after acquiring the liquid containing body 40 as in the state shown in FIG. 2C and opening the bag 410. By this, the liquid containing body 40 becomes in the state shown in FIG. 2B, namely becoming the liquid containing body 30. Thereafter, the user removes the cartridge 20 from the bag 310 by opening the bag 310. By this, the liquid containing body 30 becomes in the state shown in FIG. 2A, namely becoming the cartridge 20. Thereafter, the user equips the cartridge 20 to the holder 70 of the printer 80.

Figure 3:
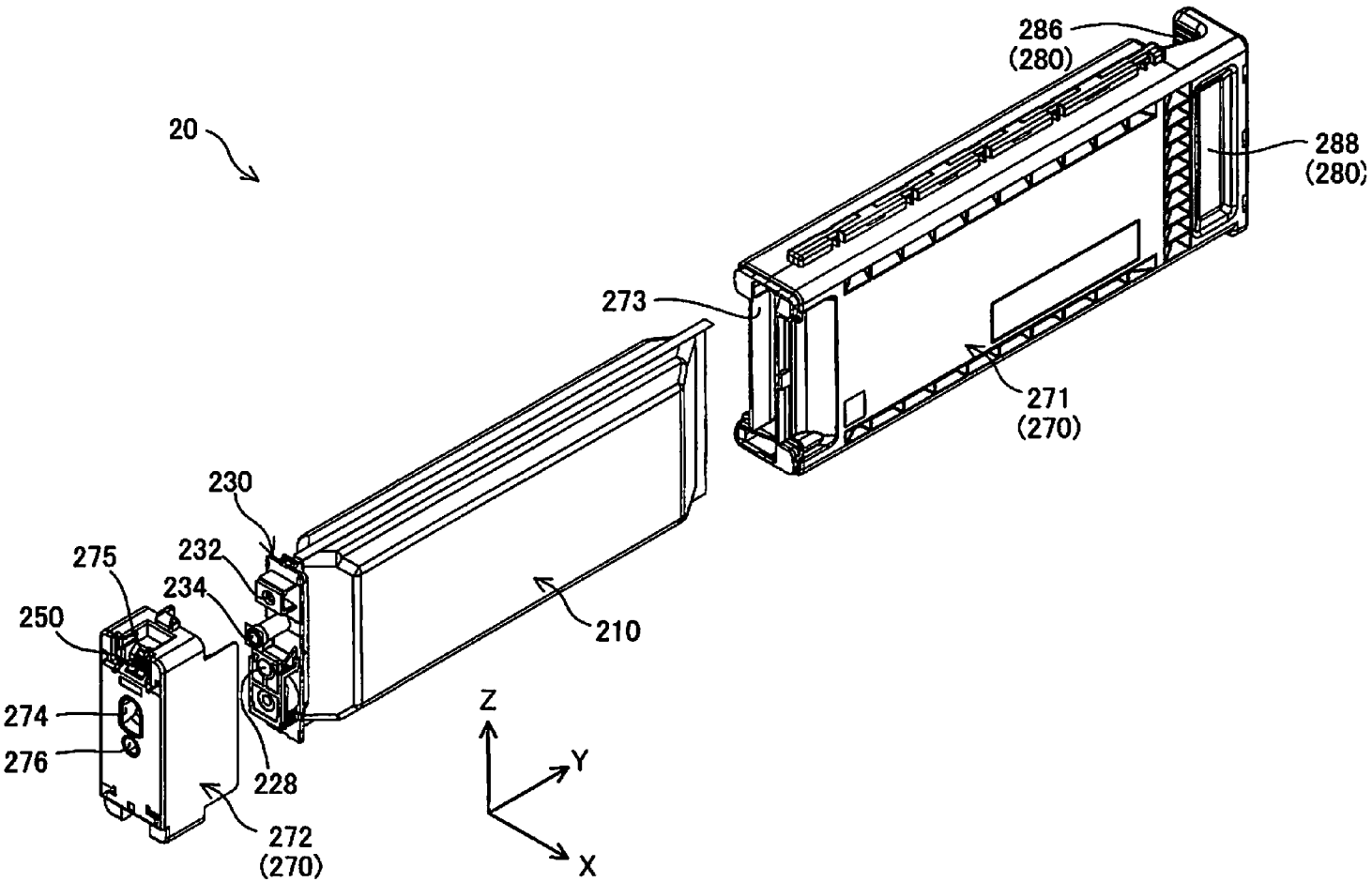
FIG. 3 is an exploded diagrammatic perspective view showing detailed configuration of a cartridge.
Figure 4:
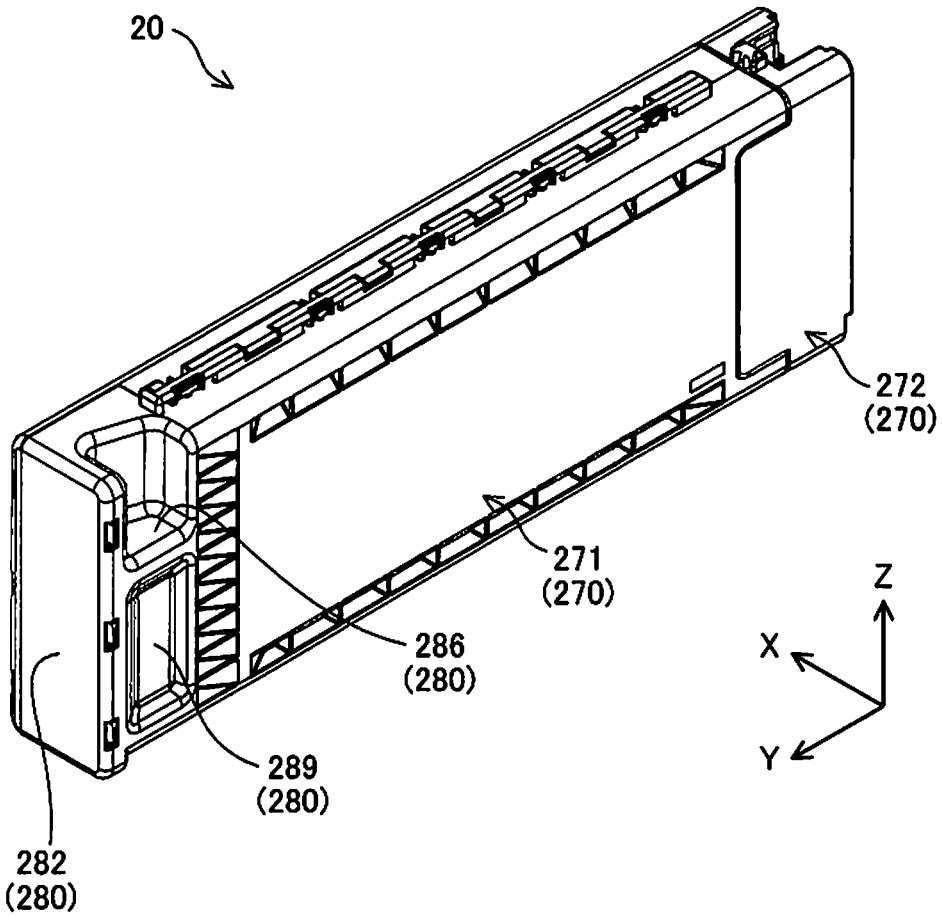
FIG. 4 is a diagrammatic perspective view showing detailed configuration of the cartridge.
Figure 5A:
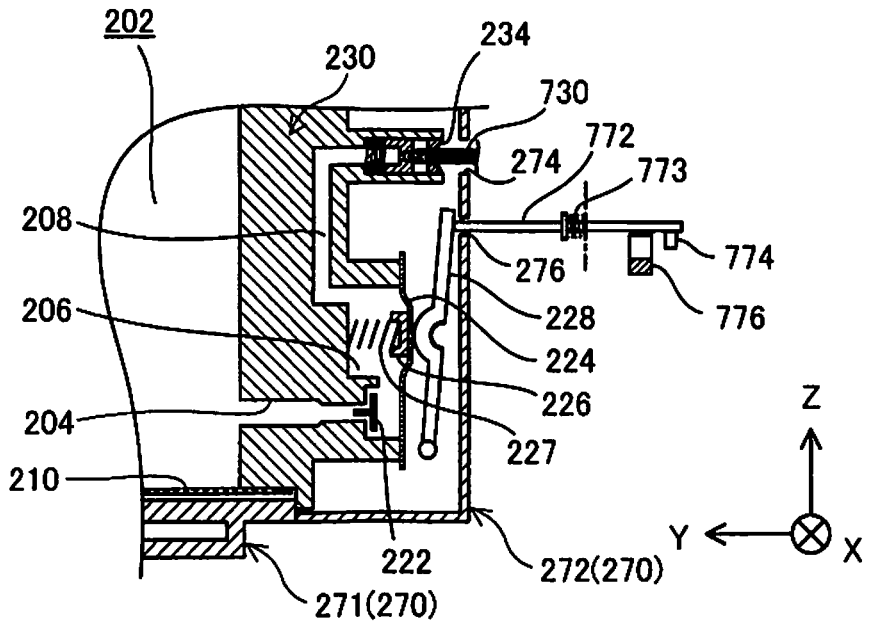
FIGS. 5A and 5B are partial sectional views showing configuration inside the cartridge.
Figure 5B:
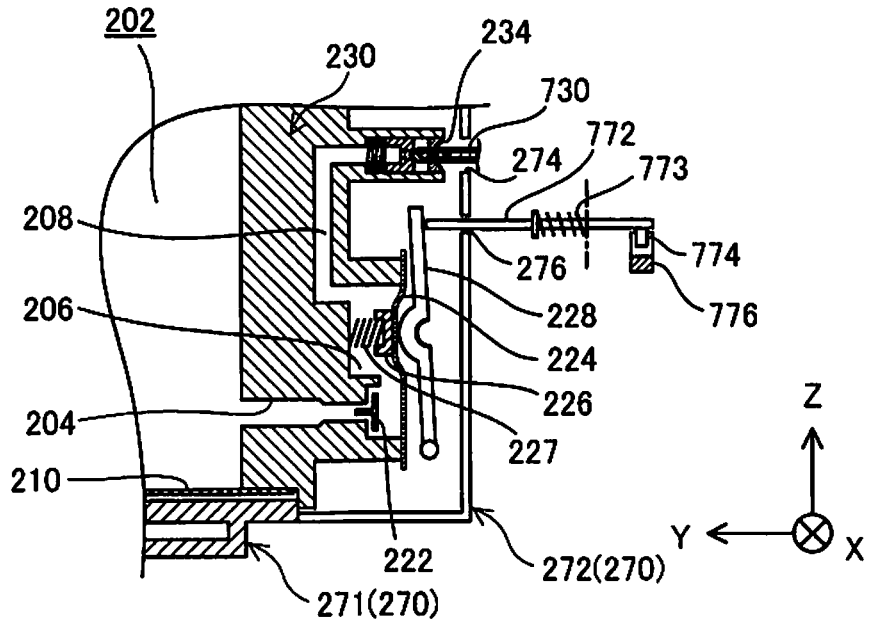

FIG. 3 is an exploded diagrammatic perspective view showing a detailed configuration of the cartridge 20. FIG. 4 is a diagrammatic perspective view showing a detained configuration of the cartridge 20. FIGS. 5A and 5B are partial sectional views showing an inside configuration of the cartridge 20.

The flexible member 210 of the cartridge 20 forms a liquid containing part 202 which has a space to contain the UV ink. The supply member 230 of the cartridge 20 includes an inlet 232 to communicate with the liquid containing part 202. A manufacturer of the cartridge 20 fills the liquid containing part 202 with the UV ink via the inlet 232 after connecting the flexible member 210 and the supply member 230. Thereafter, the manufacturer seals the inlet 232 in order to prevent leakage of the UV ink.

The supply member 230 of the cartridge 20 includes a supply port 234 to supply the UV ink from the liquid containing part 202 to the printer 80. In the present embodiment, the supply port 234 supply the UV ink to the printer 80 via a supply needle 730 by receiving insertion of the supply needle 730 configured on the holder 70 of the printer 80.

The supply member 230 forms a flow channel 204, a communicating chamber 206, and a flow channel 208 as a flow channel to flow the UV ink from the liquid containing part 202 to the supply port 234. One end of the flow channel 204 communicates with the liquid containing part 202, and the other end of the flow channel 204 communicates to the communicating chamber 206. The communicating chamber 206 includes a check valve 222 to prevent reverse flow of the UV ink from the communicating chamber 206 to the flow channel 204. One end of the flow channel 208 communicates to the communicating chamber 206, and the other end of the flow channel 208 communicates to the supply port 234. The communicating chamber 206 has a flow channel cross-sectional area which is adequately larger than the flow channel 208 and the flow channel 204. The communicating chamber 206 continuously communicates to the supply port 234 from the liquid containing part 202 for the UV ink to flow, via the flow channel 204 and the flow channel 208.

On the supply member 230, a wall member 224, a plate member 226, an elastic member 227, and a lever member 228 are configured. The wall member 224 constitutes a part of a wall which defines the communicating chamber 206 and forms the communicating chamber 206 with the supply member 230. In the present embodiment, the wall member 224 is a film made of synthetic resin and is welded to the supply member 230. The wall member 224 is urged from inside to outside the communicating chamber 206 by the elastic member 227 via the plate member 226, and is bent on the basis of inside pressure of the communicating chamber 206. The lever member 228 is in contact with the wall member 224 outside the communicating chamber 206, and largely move more than deflection amount of the wall member 224 on the basis of the bent of the wall member 224.

In the present embodiment, the wall member 224 blocks the ultraviolet light and the visible light. In the present embodiment, the wall member 224 is a colored film (for example, a laminated film having a print layer colored in back). In another embodiment, the wall member 224 can be a laminated film including an aluminum layer. In the present embodiment, absorbance of the wall member 224 is equal to or less than 0.0001% (by a measuring method of JIS (Japanese Industrial Standard) K 0115:2004) against equal to or more than 200 nm to equal to or less than 500 nm in wavelength. In another embodiment, the ball member 224 can be a part which passes the ultraviolet light and the visible light.

In the present embodiment, the lever member 228 blocks the ultraviolet light and the visible light. In the present embodiment, the lever member 228 is a part made of synthetic resin same as the supply member 230. In another embodiment, the lever member 228 can be a part made of synthetic resin different from the supply member 230.

The lever member 228 of the cartridge 20 is in contact with a bar-shaped member 772 configured on the holder 70 of the printer 80. The bar-shaped member 772 is urged towards the lever member 228 by an elastic member 773, and is movable on the basis of moving of the lever member 228. On the holder 70, a sensor 776 is configured to detect a position of the bar-shaped member 772. In the present embodiment, the sensor 776 detects the position of the bar-shaped member 772 by optically detect a protrusion section 774 configured on the bar-shaped member 772.

As FIG. 5A shows, in the state in which the cartridge 20 is equipped on the holder 70 and in which the UV ink is not sucked from a side of the printer 80, the wall member 224 of the cartridge 20 bents outwardly the communicating chamber 206 by the urge of the elastic member 227 in order to increase the capacity of the communicating chamber 206. With the increase of the capacity of the communicating chamber 206, the UV ink flows to the communication chamber 206 form the liquid containing part 202 via the flow channel 204.

In a state shown in FIG. 5A, when the UV ink is sucked to a side of the printer 80, the UV ink is supplied to the supply needle 730 via the supply port 234, and inside pressure of the communicating chamber 206 becomes lower than atmosphere pressure, as flowing-out amount of the UV ink to the communicating chamber 206 from the flow channel 204 does not catch up flowing-in amount of the UV ink to the flow channel 208 from the communicating chamber 206. By this, the wall member 224 of the cartridge 20 is bent towards inside of the communicating chamber 206, as shown in FIG. 5B.

In a case in which the UV ink is contained in the liquid containing part 202 of the cartridge 20 enough, negative pressure which occurs in the communicating chamber 206 is gradually diminished by the UV ink of the liquid containing part 202 flowing into the communicating chamber 206 via the flow channel 204. With diminishing of the negative pressure in the communicating chamber 206, the wall member 224 of the cartridge 20 is bent, as shown in FIG. 5A, towards outside of the communicating chamber 206.

In a case in which the UV ink is not contained in the liquid containing part 202 of the cartridge 20 enough, because the UV ink is not supplied from the liquid containing part 202 to the communicating chamber 206, negative pressure occurring in the communicating chamber 206 is not diminished. Thus, the wall member 224 of the cartridge 20 maintains a state in which the communicating chamber 206 is bent inwardly, as shown in FIG. 5B. In the present embodiment, the printer 80 detects a state shown in FIG. 5B by using the sensor 776, and when a prescribed time elapses in the state shown in FIG. 5B, it is notified that the cartridge 20 should be exchanged.

The container section 271 at the housing 270 of the cartridge 20 includes an opening 273 which receives the flexible member 210. The opening 273 is able to hold the supply member 230 by engaging with the supply member 230. In the present embodiment, the container section 271 has a cube shape, and includes the opening 273 at a position corresponding to a side of a cube. In the present invention, the container section 271 includes the opening 273 in the −Y axis direction and the protruding section 280 in the +Y axis direction. In the present invention, the container section 271 includes a recessed section 288 and a recessed section 289 as well as the surface section 282 and the recessed section 286, as the protruding section 280. The recessed section 288 has a shape of an outer surface being recessed of the container section 271 in the side of the +X axis direction. The recessed section 289 has a shape of an outer surface being partially bent of the container section 271 in the side of the −X axis direction.

The lid section 272 at the housing 270 of the cartridge 20 includes a through-hole 274, a though-hole 276, and a substrate mounting section 275. The through-hole 274 is configured at a position at which the supply needle 730 is insertable to the supply port 234, and in the state in which the cartridge 20 is equipped to the printer 80, the supply needle 730 penetrates the supply port 234. The through-hole 276 is configured at a position at which the bar-shaped member 772 is contactable to the lever member 228, and in the state in which the cartridge 20 is equipped to the printer 80, the bar-shaped member 772 penetrates the lever member 228. A circuit substrate 250 is attached to a circuit substrate 250, which records information with regards to the UV ink contained in the liquid containing part 202, in the substrate mounting section 275. In the state in which the cartridge 20 is equipped to the printer 80, the circuit substrate 250 is electrically connected to the holder 70, and the printer 80 is accessible to the circuit substrate 250.

A-3 Effect

According to a description of the first embodiment, in the liquid containing body 40 (FIG. 2C), because the light shielding property is attained by the bag 410, it is possible to enhance material and degree of freedom in design of shapes of the flexible member 210 and the supply member 230. Also, in the liquid containing body 30 (FIG. 2B) with the bag 310 being removed from the bag 410, because the user can confirm the leakage of the UV ink from outside of the bag 310, it is possible to prevent the user from making contact to the UV ink.

Also, the flexible member 210 and supply member 230 which are sealed in the bag 310 is in the bag 410. For this reason, when compared with the case in which the bag 410 is sealed, it is possible to prevent the bag 310 from being damaged when the bag 410 is opened because the user easily open the bag 410. As a result, in a state in which the UV ink is leaked inside the bag 310, it is possible to prevent the user from being contact with the UV ink due to damaging the bag 310 when the bag 410 is opened.

Also, because the bag 310 is housed in the bag 410 in a state in which the bag 410 having the light shielding property is bent or partially closed, the user can easily open the bag 410 in this case compared with the case in which the bag 410 is sealed. For this reason, it is possible to prevent the bag 310 from being damaged by mistakenly opening the bag 410, and it is possible to enhance the light shielding property against the UV ink. As a result, in the state in which the UV ink is leaked inside the bag 310, it is possible to prevent the user from being in contact with the UV ink and inhibit hardening the UV ink by the damage of the bag 310 in opening the bag 410.

Also, because the supply member 230 blocks the ultraviolet light and the visible light, it is possible to prevent the UV ink from being hardened by the ultraviolet light and the visible light passing through the supply member 230, in the state in which the bag 410 is removed.

Also, because the light shielding property is attained by the housing 270 in the state in which the bag 410 is removed, it is possible to enhance the degree of freedom in design of the flexible member 210 without limitation in attaining the light shielding property.

Also, the supply member 230, the wall member 224, and the lever member 228 block the ultraviolet light and the visible light, it is possible to prevent the UV ink from being hardened by the ultraviolet light and the visible light passing through the supply member 230, the wall member 224, and the lever member 228, in the state in which the bag 410 is removed.

Also, for the liquid containing body 40, the absorbance in a range from the outside of the bag 410 to the inside of the flexible member 210 in the liquid containing body 40 is equal to or less than 0.0001% against equal to or more than 200 nm to equal to or less than 500 nm in wavelength. For this reason, it is possible to attain the light shielding property enough to block hardening the UV ink.

B. Second Embodiment

The liquid ejecting system of the second embodiment is same as the first embodiment except the configuration of the cartridge.

Figure 6:
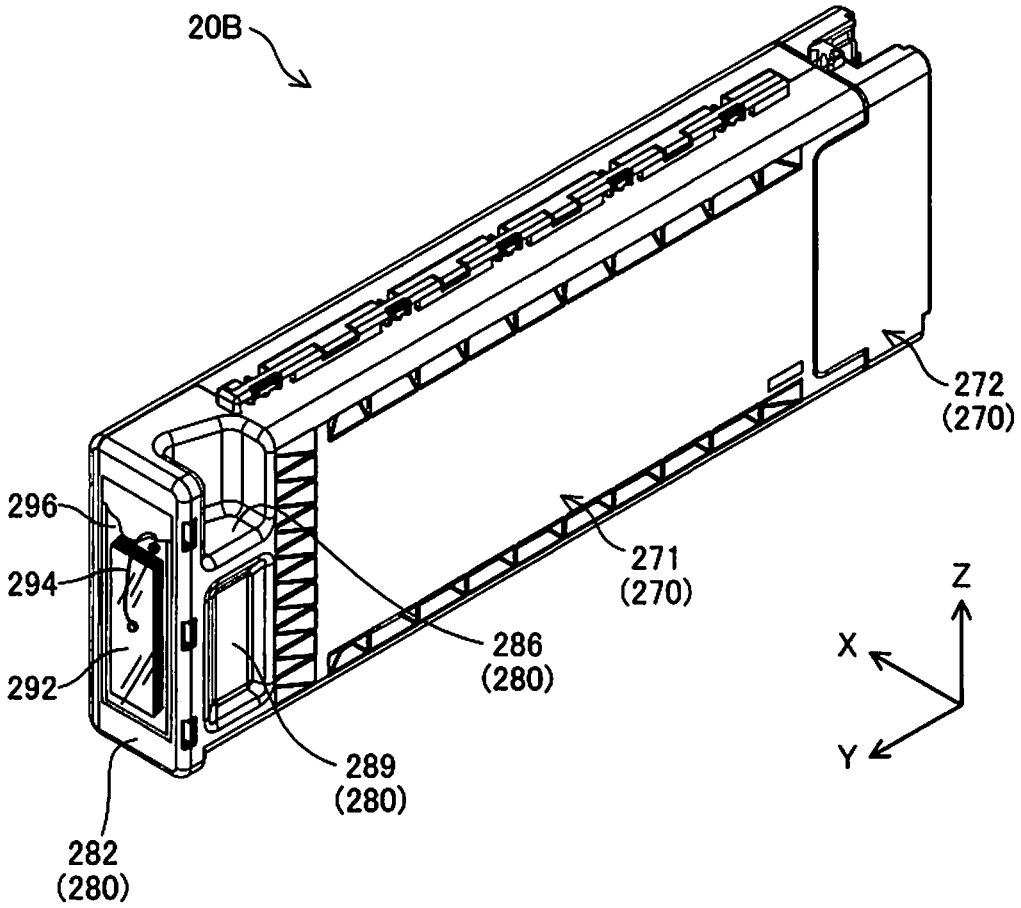
FIG. 6 is a diagrammatic perspective view showing detailed configuration of the cartridge of a second embodiment.
Figure 7:
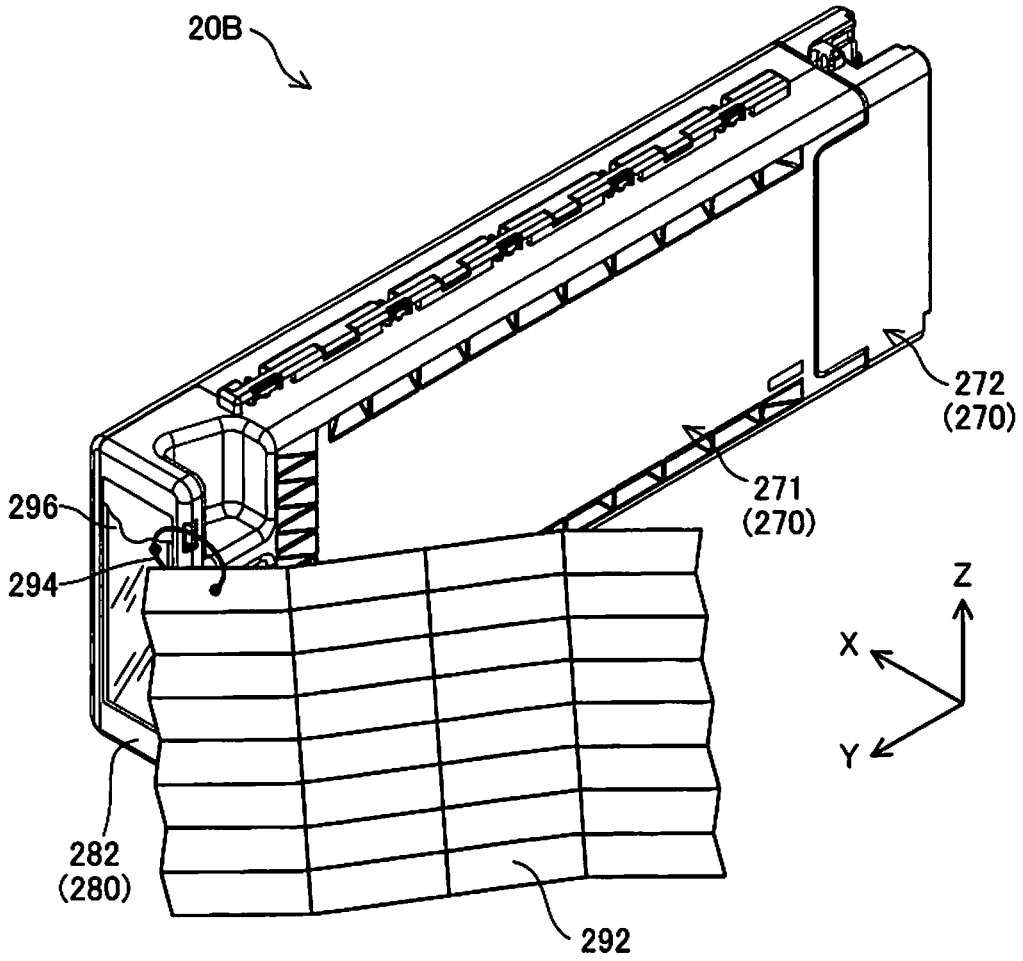
FIG. 7 is a diagrammatic perspective view showing detailed configuration of the cartridge of the second embodiment.

FIGS. 6 and 7 are diagrammatic perspective views showing detail configurations of a cartridge 20B of the second embodiment. The cartridge 20B of the second embodiment is same as the cartridge 20 of the first embodiment except a medium 292 on which information with regards to the UV ink is recorded. For the cartridge 20B, the medium 292 is configured on the protruding section 280. In the present embodiment, the medium 292 is paper on which the information with regards to the UV ink (for example, component, color, instruction, and the like) contained in the liquid containing part 202.

In the present embodiment, the cartridge 20B includes a coupling tool 294 and a bag 296. The coupling tool 294 connects the medium 292 to the bag 296. In the present embodiment, the coupling tool 294 is a string made of synthetic resin. The bag 296 has a bag shape to contain the medium 292 being folded, and bonded to the protruding section 280. In the present embodiment, the bag 296 is bonded to the surface section 282 by a double-stick tape. In the present embodiment, the bag 296 is made of transparent synthetic resin.

The cartridge 20B shown in FIG. 6 is in a state in which the medium 292 being folded is housed in the bag 296. The cartridge 20B shown in FIG. 7 is in a state in which the medium 292 is removed from the bag 296 and unfolded.

According to the second embodiment mentioned above, because the light shielding property is attained by the bag 410 in the liquid containing body 40 (FIG. 2C), same as in the first embodiment, a degree of freedom in design in material and shapes of the flexible member 210 and the supply member 230 is enhanced. Also, in the liquid containing body 30 (FIG. 2B) in the bag 310 removed from the bag 410, because the user can confirm the leakage of the UV ink from the outside of the bag 310, it is possible to prevent the user from being in contact with the UV ink. Also, for the cartridge 20B, because the medium 292 is configured on the protruding section 280, it is possible to indicate the information with regards to the UV ink at a place which is seeable to the user, for the printer 80.

C. Third Embodiment

The liquid ejecting system of the third embodiment is same as the first embodiment except the configuration of the cartridge.

Figure 8:
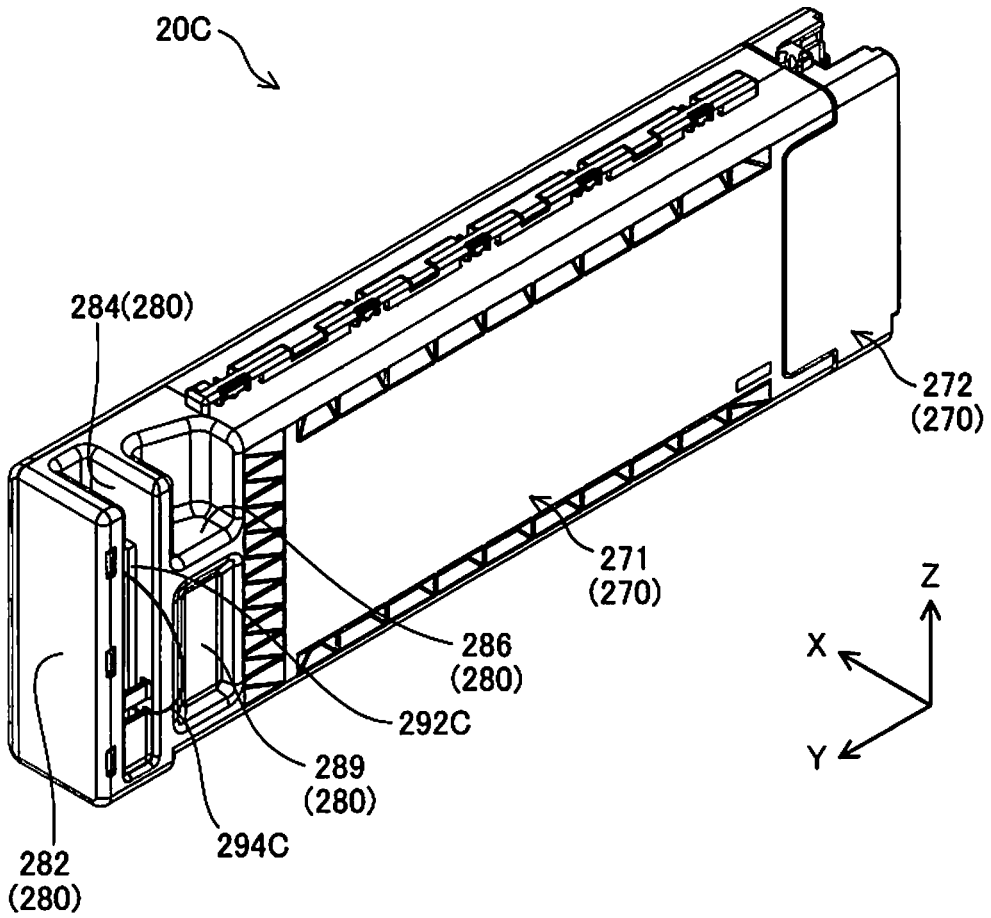
FIG. 8 is a diagrammatic perspective view showing detailed configuration of the cartridge of a third embodiment.
Figure 9:
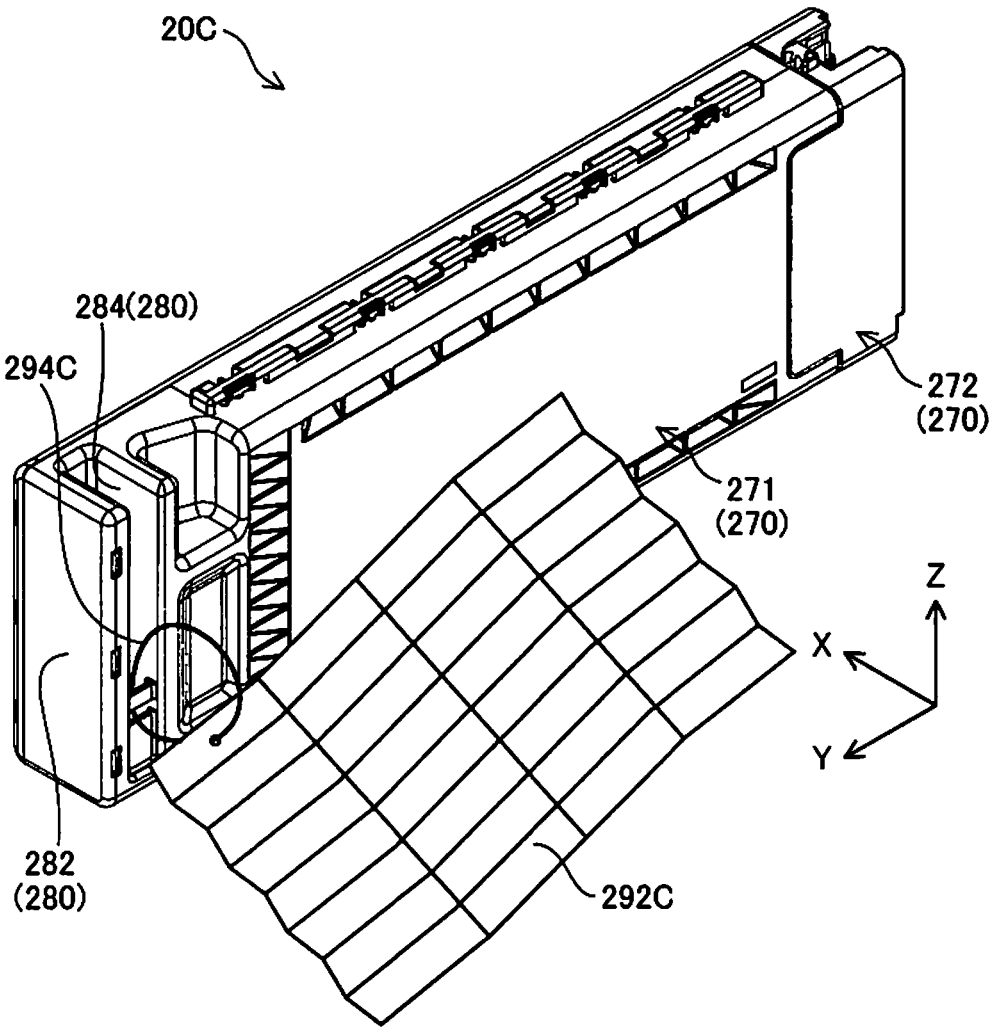
FIG. 9 is a diagrammatic perspective view showing detailed configuration of the cartridge of the third embodiment.

FIGS. 8 and 9 are diagrammatic perspective views showing a detailed configuration of the cartridge 20C of the third embodiment. The cartridge 20C of the third embodiment is same as the cartridge 20 of the first embodiment except the medium 292C on which the information with regards to the UV ink is recorded. For the cartridge 20C, the medium 292C is configured on the protruding section 280. In the present embodiment, the medium 292C is paper on which the information (for example, component, color, and instruction) with regards to the UV ink contained the liquid containing part 202.

In the present embodiment, the cartridge 20C includes a storing part 284 and the coupling tool 294C. The storing part 284 has a shape of an outer surface being recessed of the protruding section 280 in order to house the medium 292 being folded. In the present embodiment, the storing part 284 is configured on the container section 271. The coupling tool 294C connects the medium 292C and the storing part 284. In the present embodiment, the coupling tool 294C is a string made of synthetic resin.

The cartridge 20C shown in FIG. 8 is in a state in which the medium 292C being folded is housed in the storing part 284. The cartridge 20C shown in FIG. 9 is in a state in which the medium 292C is removed from the storing part 284.

According to the third embodiment described above, because the light shielding property is attained by the bag 410 in the liquid containing body 40 (FIG. 2C) same as in the first embodiment, a degree of freedom in design, material, shapes of the flexible member 210 and the supply member 230 is enhanced. Also, with the liquid containing body 30 (FIG. 2B) in the state in which the bag 310 is removed from the bag 410, because the user can confirm the leakage of the UV ink from the outside of the bag 310, it is possible to prevent the user from being in contact with the UV ink. Also, for the cartridge 20C, because the medium 292C is configured on the protruding section 280, the information with regards to the UV ink can be indicated at the position which is seeable by the user for the printer 80.

D. Other Embodiments

The present invention is not limited to the abovementioned arrangements, the embodiments, and the modified examples, and can be realized in various kinds as long as staying in a range within its concept. For example, the technical features of the arrangements, the embodiments, and the modified examples to which the technical features in each of arrangements recited in Summary of Invention can be changed and combined, as necessary, in order to solve partially and entirely the problems mentioned above, or to realize partially or entirely the effects mentioned above. Also, it is possible to delete, as necessary, as long as the technical features are not described as required in the present specification.

The present invention is not limited to an ink cartridge containing UV ink. Also, it can be applied to a liquid ejecting device which ejects other liquid not being hardened by irradiation of light with wavelength other than ultraviolet light, and its liquid container. For example, it can be applied to various types of liquid ejecting device and its liquid container such as Image recording device such as facsimile devices, Color material ejecting devices used for manufacturing color filters for image display devices such as liquid crystal displays, Electrode material ejecting devices used for forming electrodes such as electro luminescence displays (electro luminescence) and filed emission displays (filed emission display, FED).

Liquid ejecting devices ejecting liquid including bioorganic substances used for biochip manufacturing Sample ejecting devices as precision pipettes Grease ejecting devices Resin solution ejecting devices Liquid ejecting devices ejecting grease with pinpoint accuracy to precision machines such as watches and cameras, Liquid ejecting devices ejecting transparent resin solution on a substrate such as ultraviolet light hardening resin solution in order to form micro-hemispherical lens (optical lens) which is used for optical communication elements and the like, Liquid ejecting devices ejecting etching liquid being acidic or alkaline to perform etching a substrate, and Liquid ejecting devices including liquid ejecting head which ejects other very small liquid drops.

Further, "liquid drop" is a state in which liquid is ejected from a liquid ejecting device including granular liquid, tear drop shape of liquid, stringy liquid, and the like. Also, "liquid" can be a material which is ejectable by the liquid ejecting device. For example, "liquid" can be a material in a liquid form, and materials in liquid form such as sol, gel water, inorganic solvent, organic solvent, solvent, liquid resin, and liquid metal (metallic melt) is included in "liquid." Also, not only the liquid as a state of substance, particles of functional materials, which is from solid objects such as pigments and metal particles, being dissolved, dispersed, or combined are also included in "liquid." A typical example of liquid is ink and liquid crystal. Here, "ink" includes ordinary aqueous ink, and oil ink, as well as gel ink, hot melt ink, and other kinds of liquid form composition.

Further, "blocking light" and "acquiring light shielding property" mean having characteristic of blocking light, and in the present embodiment, it is fine as long as having characteristic to block light with wavelength which hardens the ink when irradiating to the ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid containing body comprising a flexible member configured to contain a liquid which is hardened by irradiation of ultraviolet light;

a supply member connected to the flexible member, the supply member including a supply port configured to supply the liquid to a liquid ejecting device from the flexible member;

a first containing body housing the flexible member and the supply member, the first containing body being transparent or translucent to allow the ultraviolet light to pass through; and a second containing body housing the first containing body, the second containing body being configured to block the ultraviolet light and visible light.

2. The liquid containing body according to claim 1, wherein the flexible member and the supply member are sealed in the first containing body, and the first containing body is partially closed in the second containing body.

3. The liquid containing body according to claim 1, further comprising a protruding section protruding from an applied section in a state in which the supply member is equipped on the applied section of the liquid ejecting device, and a medium on which information with regards to the liquid is described, the medium being arranged on the protruding section.

4. The liquid containing body according to claim 1, wherein the supply member is configured to block the ultraviolet light and the visible light.

5. The liquid containing body according to claim 1, further comprising a housing housed in the first containing body, and housing the flexible member and the supply member, the housing being configured to block the ultraviolet light and the visible light, wherein the flexible member is configured to allow the ultraviolet light and the visible light to pass through.

6. The liquid containing body according to claim 5, wherein the supply member forms a communicating chamber continuously communicating to the supply port from an inside of the flexible member for the liquid to flow, the liquid containing body further comprises a wall member which is arranged in the supply member, forms the communicating chamber with the supply member, and is configured to bend based on internal pressure of the communicating chamber, and a lever member which is arranged on the supply member, is in contact with the wall member, and is configured to move largely in comparison with amount of bending of the wall member based on the bending of the wall member, and the supply member, the wall member, and the lever member are configured to block the ultraviolet light and the visible light.

7. The liquid containing body according to claim 1, wherein absorbance in a range from an outside of the second containing body to an inside of the flexible member in the liquid containing body is equal to and less than 0.0001% against equal to and more than 200 nm to equal to and less than 500 nm in wavelength.

* * * * *